US005690545A

United States Patent [19]

Clowers et al.

[11] Patent Number: 5,690,545

[45] Date of Patent: Nov. 25, 1997

[54] MOTORIZED ROTARY TOOL HAVING A HEAD MOUNTED BY A PIVOTAL JOINT

[75] Inventors: Earl Roger Clowers, Jackson; Steve Harry Plume, Humboldt; John Charles Smith, Jackson, all of Tenn.

[73] Assignee: Porter-Cable Corporation, Jackson, Tenn.

[21] Appl. No.: 695,644

[22] Filed: Aug. 12, 1996

Related U.S. Application Data

[63] Continuation of Ser. No. 389,800, Feb. 16, 1995, Pat. No. 5,545,080.

[51] Int. Cl.[6] ..... B24B 27/027

[52] U.S. Cl. ..... 451/359; 451/354; 451/456; 15/28

[58] Field of Search ..... 15/344, 392, 28, 15/52; 29/81.13, 81.17; 403/112, 113; 451/353, 354, 456, 359; 81/57.27

[56] References Cited

U.S. PATENT DOCUMENTS

| | | | |
|---|---|---|---|
| 837,115 | 11/1906 | Plummer et al. | 451/353 X |
| 1,067,280 | 7/1913 | Smilovetz . | |
| 1,582,664 | 4/1926 | Bennington . | |
| 1,653,108 | 12/1927 | Koenig | 451/359 |
| 1,728,487 | 9/1929 | Gardner . | |
| 1,919,854 | 7/1933 | Masseau . | |
| 1,927,186 | 9/1933 | Raaen . | |
| 2,711,059 | 6/1955 | Ames . | |
| 2,753,669 | 7/1956 | Larson . | |
| 3,646,712 | 3/1972 | Quintana . | |
| 3,815,292 | 6/1974 | Hutchins . | |
| 3,826,045 | 7/1974 | Champayne . | |
| 4,131,966 | 1/1979 | Gross | 451/359 X |
| 4,202,067 | 5/1980 | Stamatovic | 451/359 X |
| 4,685,252 | 8/1987 | Ponce | 451/354 |
| 4,697,389 | 10/1987 | Romine . | |
| 4,782,632 | 11/1988 | Matechuk . | |
| 4,848,037 | 7/1989 | Happe . | |
| 5,239,783 | 8/1993 | Matechuk . | |
| 5,398,454 | 3/1995 | Berner | 451/359 X |

OTHER PUBLICATIONS

Parts List No. 877748–498, "Porter–Cable Drywall Sander", by Porter–Cable Corporation, (1994).

Instruction Manual, "Drywall Sander", by Porter–Cable Corporation, (1994).

*Primary Examiner*—Timothy V. Eley

*Attorney, Agent, or Firm*—Merchant, Gould, Smith, Edell, Welter & Schmidt, P.A.

[57] ABSTRACT

A motorized rotary tool having a drive motor mounted on a distal end of a tubular wand is provided. A drive shaft is operatively coupled to the drive motor and extends along the length of the tubular wand. A head is mounted by a pivotal joint to a proximal end of the tubular wand. The head includes a rotary pad operatively coupled to the flexible drive shaft such that the rotary pad can be driven rotably by the drive shaft. The pivotal joint has a first and a second flexible joint. The first joint is configured to pivot about a first axis which is different from a second axis about which the second joint pivots.

16 Claims, 10 Drawing Sheets

MOTORIZED ROTARY TOOL HAVING A HEAD MOUNTED BY A PIVOTAL JOINT

This is a Continuation of application Ser. No. 08/389,800, filed Feb. 16, 1995, and now U.S. Pat. No. 5,545,080.

FIELD OF THE INVENTION

The present invention relates generally to a motorized sander. More particularly, the present invention relates to a motorized sander with a sanding head pivotal joint having a first and a second flexible joint, where the first joint is configured to pivot about a first axis which is different from a second axis about which the second joint pivots.

BACKGROUND OF THE INVENTION

In drywall construction it is necessary, after taping and filling the joints between the panels, to sand the joint to reduce it to the same level as the adjacent panels and thus obscure any evidence of a joint.

In the past this had been done with manual sanders consisting simply of a supporting block and a section of abrasive material on the block. An improved power operated sander was disclosed in U.S. patent application Ser. No. 07/103,362, now U.S. Pat. No. 4,782,632, filed on Oct. 1, 1987, which is entitled "Drywall Sander" by Matechuk. In addition, U.S. patent application Ser. No. 07/901,694, now U.S. Pat. No. 5,239,783, filed on Jun. 22, 1992, which is entitled "Drywall Sander" by Matechuk, which was a continuation-in-part of the Matechuk '632 patent, describes certain improvements to the overall operation of the sander and some enhanced convenience features. In particular, refinements to the use of a vacuum hose were added. Also, an improved replacement procedure for the sanding surface was provided so that the operator no longer was required to remove a retaining bolt which held the sanding disc in place. Such a retaining bolt often times caused a delay in operating the sander when a screwdriver or other tools had to be found and used during the sanding surface replacement procedure.

Extraction of dust during operation of the sander is of great importance. The design of those areas in a sander through which the dust passes determines the continuing effectiveness of the extraction system as does the selection of the vacuum system.

Also, certain peculiarities to the sanding of drywall which may not be of the same importance in other sanding applications exist. The material used to cover the tape and fill the joint is easily abraded and care must be taken to avoid scoring the surface. The paper surface of the plaster board is also easily damaged when sanding. Selection of suitable characteristics of the abrasive material becomes of great importance. Also, the amount of force applied to the surface by the sanding pad and concentration of force on particular areas affects the final result.

The Matechuk '783 patent describes incorporating the vacuum line into the handle of the sander which eliminates the loose vacuum line adjacent the sanding head. Also, the shroud surrounding the sanding disc is contoured to provide a smooth, substantially constant, cross-sectioned duct for air flow from the sanding head into the handle and out to a vacuum system which is selected to handle the large quantities of dust produced during the sanding of drywall. Finally, to increase efficiency, the sanding disc is held on the drive plate by a quick release high compression locking device which permits rapid and positive replacement of worn abrasive discs.

The abrasive disc or pad used for sanding should be specially designed in view of the nature of the surface being sanded. One such abrasive pad is described in U.S. patent application Ser. No. 08/288,233, filed on Aug. 9, 1994, which is entitled "Abrasive Pad" by Chambers et al. In the case of drywall the abrasive pad should have a foam backing and should be faced with a grit of suitable size. Preferably the grit is coated directly on the foam but in any case the pad must retain its flexibility. The foam is selected to have a non-linear compression characteristic so that, when compressed, the force required to produce a given deflection increases as the foam is compressed. The foam also has what may be termed a quick memory; that is, when compressed and released the foam quickly recovers its original thickness.

Both the Matechuk '632 patent and the Matechuk '783 patent show and describe a pivot mechanism for the sanding head which only pivots the sanding head about a single axis. A user of a motorized sander typically needs to sand drywall surfaces on the walls and ceiling during a sanding session. In order to sand several of these surfaces with a motorized sander that pivots about a single axis, the user needs to move about the sanding area and change positions frequently.

Therefore, a need exists for a mechanism which enables the sanding head to pivot through several axes of rotation so that the user does not need to change positions as frequently as is required when using other motorized sanders.

The present invention provides a solution to this and other problems, and offers other advantages over the prior art.

SUMMARY OF THE INVENTION

The present invention relates to a motorized sander with a pivotal joint.

In one embodiment, a motorized sander having a drive motor mounted on a distal end of a tubular wand is provided. A flexible drive shaft is operatively coupled to the drive motor and extends along the length of the tubular wand. A sanding head is mounted by a pivotal joint to a proximal end of the tubular wand. The sanding head includes a sanding pad operatively coupled to the flexible drive shaft. The pivotal joint has a first and a second flexible joint. The first joint is configured to pivot about a first axis which is different from a second axis about which the second joint pivots.

These and various other features as well as advantages which characterize the present invention will be apparent upon reading of the following detailed description and review of the associated drawings.

BRIEF DESCRIPTION OF THE DRAWINGS

FIG. 4 is a top view of the sander head portion shown in FIG. 2.

DETAILED DESCRIPTION OF THE PREFERRED EMBODIMENT

The following discussion will detail the construction, arrangement, and operation of a preferred embodiment drywall sander. It will be appreciated by those skilled in the art that this motorized sander may also be used for scuffing or roughing up a painted surface prior to applying another coat of paint. In addition, it may be used as a floor buffer, device for removing barnacles on fiberglass boats, removing textures on a ceiling, wallpaper, and wallpaper paste as well as other assorted planar surface sanding operations. Further, many types of motorized sanders, besides drywall sanders, may be manufactured in accordance with the teachings of the present description without departing from the scope and spirit of the present invention as claimed.

Figure 1:
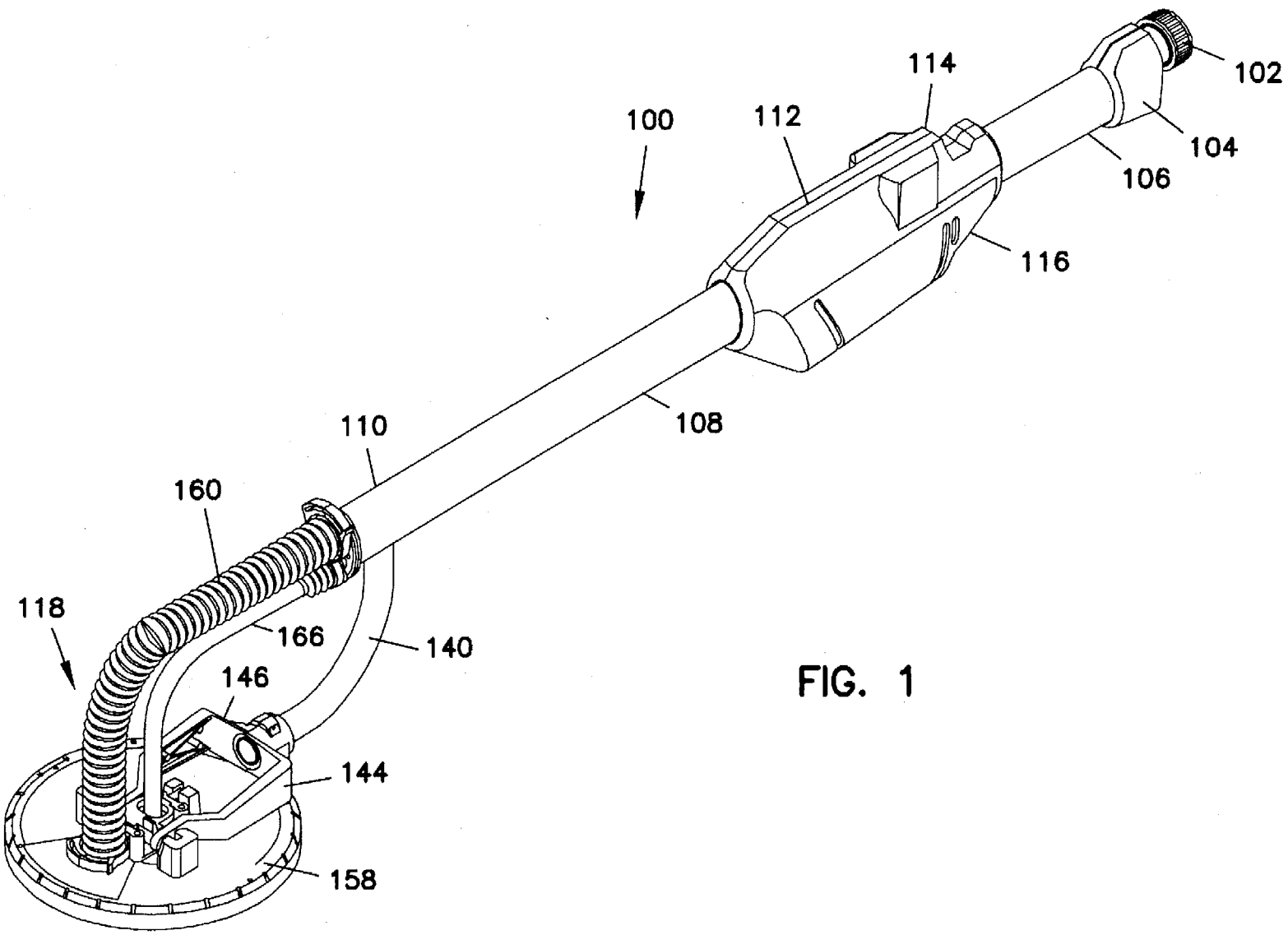
FIG. 1 is an isometric view of a motorized sander.

Referring now to FIG. 1, an isometric view of a motorized sander is shown. The motorized sander 100 includes a hose clamp nut 102 attached to a vacuum adapter housing set 104 which in turn is attached to a distal end 106 of a dual chamber tubular wand 108. The tubular wand 108 also has a proximal end 110.

A drive motor 112 preferably is mounted near the distal end 106 of the tubular wand 108. Drive motor 112 preferably is operably coupled in-line with the tubular wand 108. Drive motor 112 is mounted at this end 106 so that sander 100 has a balancing point near the middle of the length of tubular wand 108 when a sanding head 118 is attached to the proximal end 110. The drive motor preferably is a variable speed fractional horse power electric motor such as those which are commonly used for electric drills. The drive motor 112 includes an on/off toggle switch 114. Motor speed is varied by a variable speed thumb wheel switch 116 located on the opposite side of the tubular wand 108 from the on/off switch 114.

The dual chamber tubular wand 108 includes a first lower chamber 120 and a second upper chamber 122 which extend along the length of the tubular wand 108. The first 120 and the second 122 chambers are more clearly shown in FIG. 2 which is an exploded view of the sander head 118 portion of the motorized sander 100.

A flexible drive shaft 124 within a guide tube 126 is coupled to the drive motor 112 and extends along the length of tubular wand 108 towards the proximal end 110 within the first chamber 120. A vacuum line extends through the second chamber 122 from the proximal end 110 to the distal end 106 to the vacuum hose clamp 102. This vacuum line within the second chamber 122 is completely separate and sealed from the first chamber 120 of the tubular wand 108 as well as being sealed from the drive motor 112. As a result any dust or vacuumed material passing through the vacuum line does not come into contact with either the flexible drive shaft 124 or the drive motor 112 as it passes through the tubular wand 108. It should be noted that the vacuum hose clamp 102 is preferably configured to receive a flexible vacuum hose (not shown).

The sanding head 118 is mounted by a pivotal joint to the proximal end 110 of the tubular wand 108. The sanding head 118 includes preferably a sanding drive plate 128 that is operatively coupled to the flexible drive shaft 124. The flexible drive shaft 124 is not securely fastened to sanding drive plate 128, but rather is loosely fit into a slotted drive hole 130 within the threaded spindle 196 which allows the flexible drive shaft 124 to move back and forth between the sanding head 118 and the drive motor 112 as the sanding head 118 is pivoted/bent into various positions. The pivotal joint preferably includes a first flexible joint 132 and a second flexible joint 134. The first joint 132 is configured to pivot about a first axis 136 which is different from a second axis 138 about which the second joint 134 pivots. In the preferred embodiment the first axis 136 is perpendicular to the second axis 138.

The first joint 132 comprises a U-joint having a rigid tube 140 to fit into a rotatable collet 142 formed by support arms 144 and 146 which form a U-shaped retaining member. The rotatable collet 142 and the U-shaped retaining member preferably are configured to freely pivot about the first axis 136 on the rigid tube 140.

The second joint 134 includes a first pin 148 mounted between the open ends of arms 144 and 146 of the U-shaped retaining member. The sanding head 118 is coupled to the first pin 148 such that the sanding head pivots about the second axis 138 which extends along the length of the first pin 148.

It will be appreciated by those skilled in the art that having the two axis of rotation significantly improves the pivoting capability of the sanding head over a sander that only pivots about a single axis. Additional pivoting capabilities are provided in the preferred embodiment detailed herein by having a third joint 150 configured to pivot about a third axis 152 which is different from the first 136 and the second 138 axes. The third joint 150 includes a rigid plate 154 located between the open ends of arms 144 and 146 of the U-shaped retaining member. A second pin 156 is mounted perpendicular to the first pin 148. Both pins 148 and 156 thread into holes in the rigid plate 154. The third axis 152 extends along the length of the second pin 156 when the motorized sander 100 is fully assembled.

The sanding head further includes a shroud 158 surrounding a peripheral edge of the sanding drive plate 128. The vacuum line extends from the proximal end 110 of the tubular wand 108 through a hose 160 and is operatively coupled to a vacuum hole 162 by a hose clamp 164. The vacuum hole 162 is located on the shroud 158 and extends therethrough. The shroud 158 also includes a recessed region 166 and surrounds the vacuum hole 162. The recessed region 166 is better detailed in FIG. 3 which is a bottom view of the sander head 118 of FIG. 2 on section line 3—3. The recessed region 166 includes ridges 168 which protrude up from the recessed region 166 such that the rotary drive plate 128 is prevented from sealing the vacuum hole 162 when forces apply to the planar surface of the sanding drive plate 128 towards the shroud 158.

Figure 2:
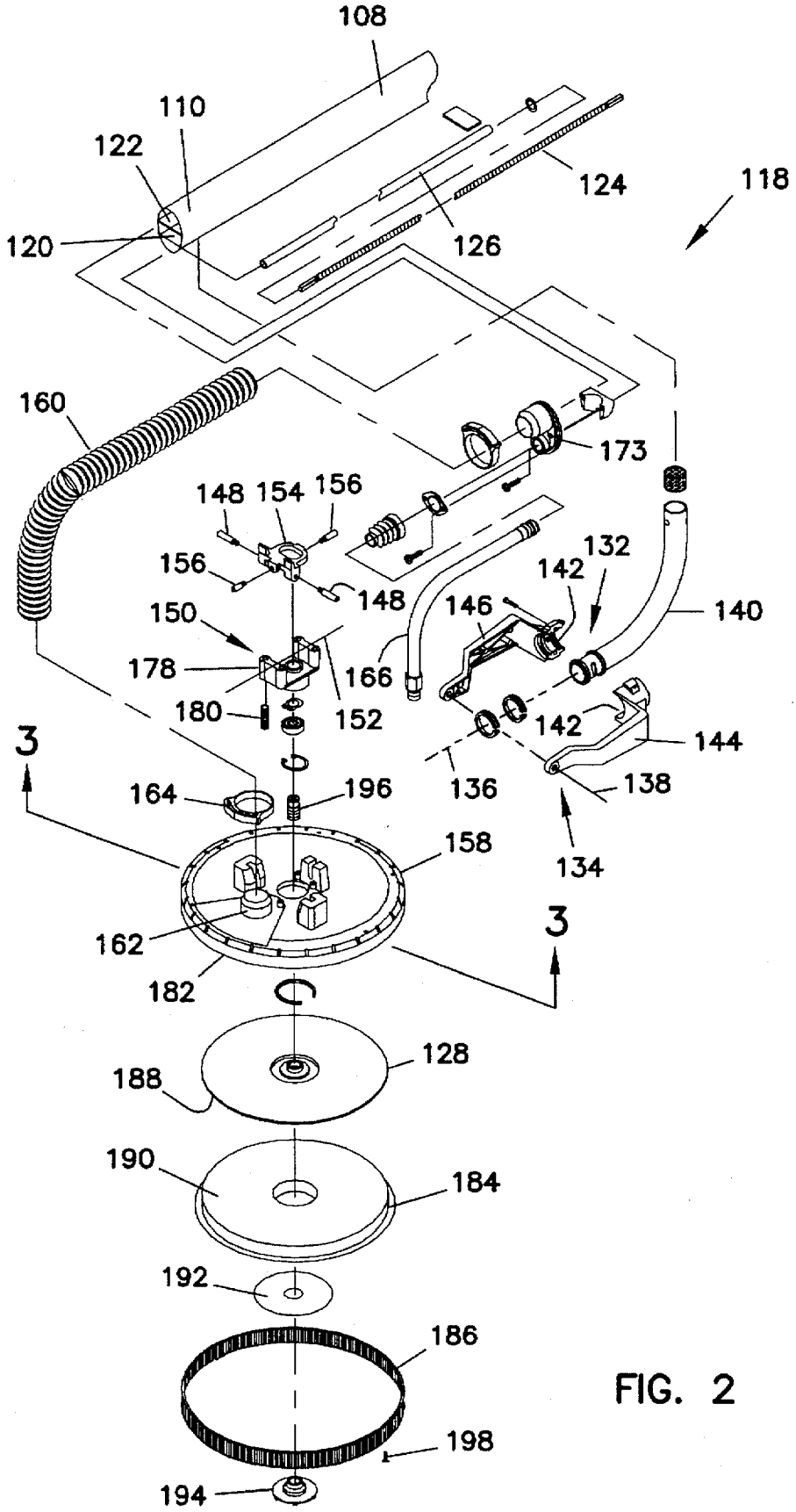
Figure 3:
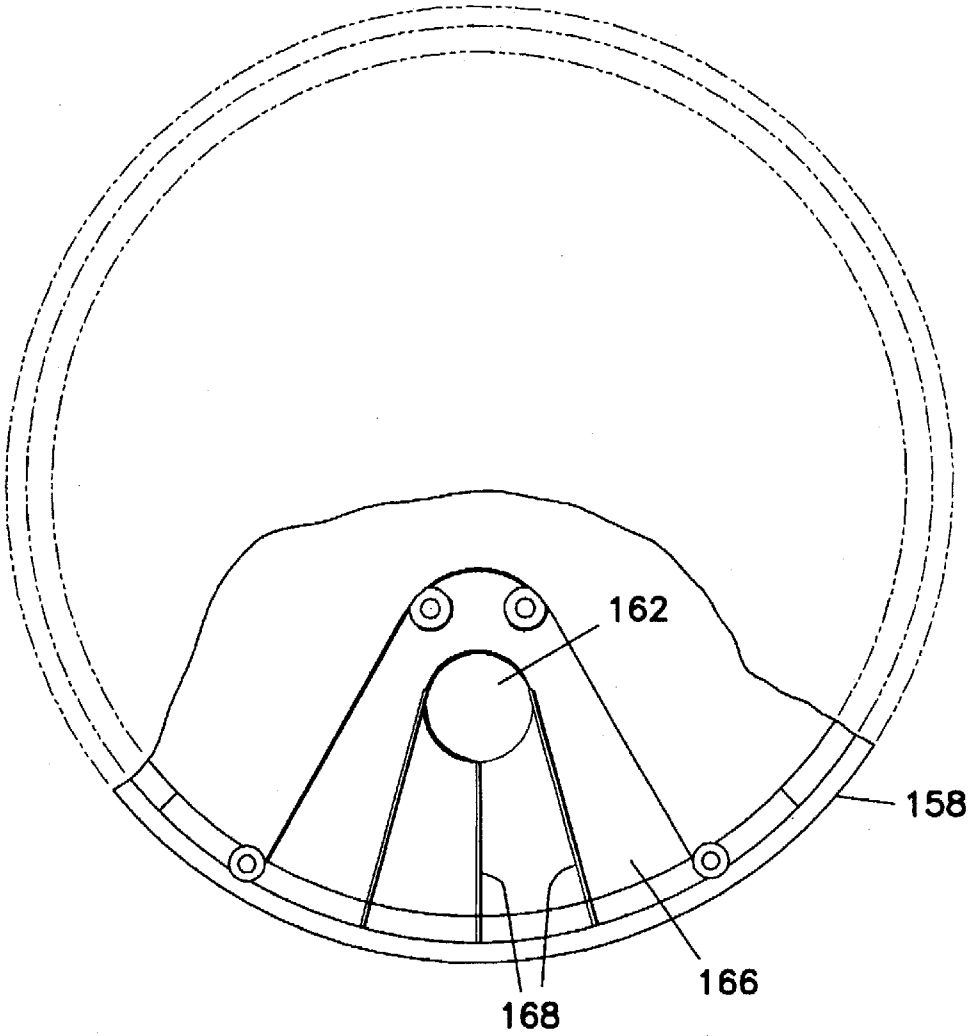
FIG. 3 is a bottom view of the sander head portion shown in FIG. 2 at section line 3—3.
Figure 4:
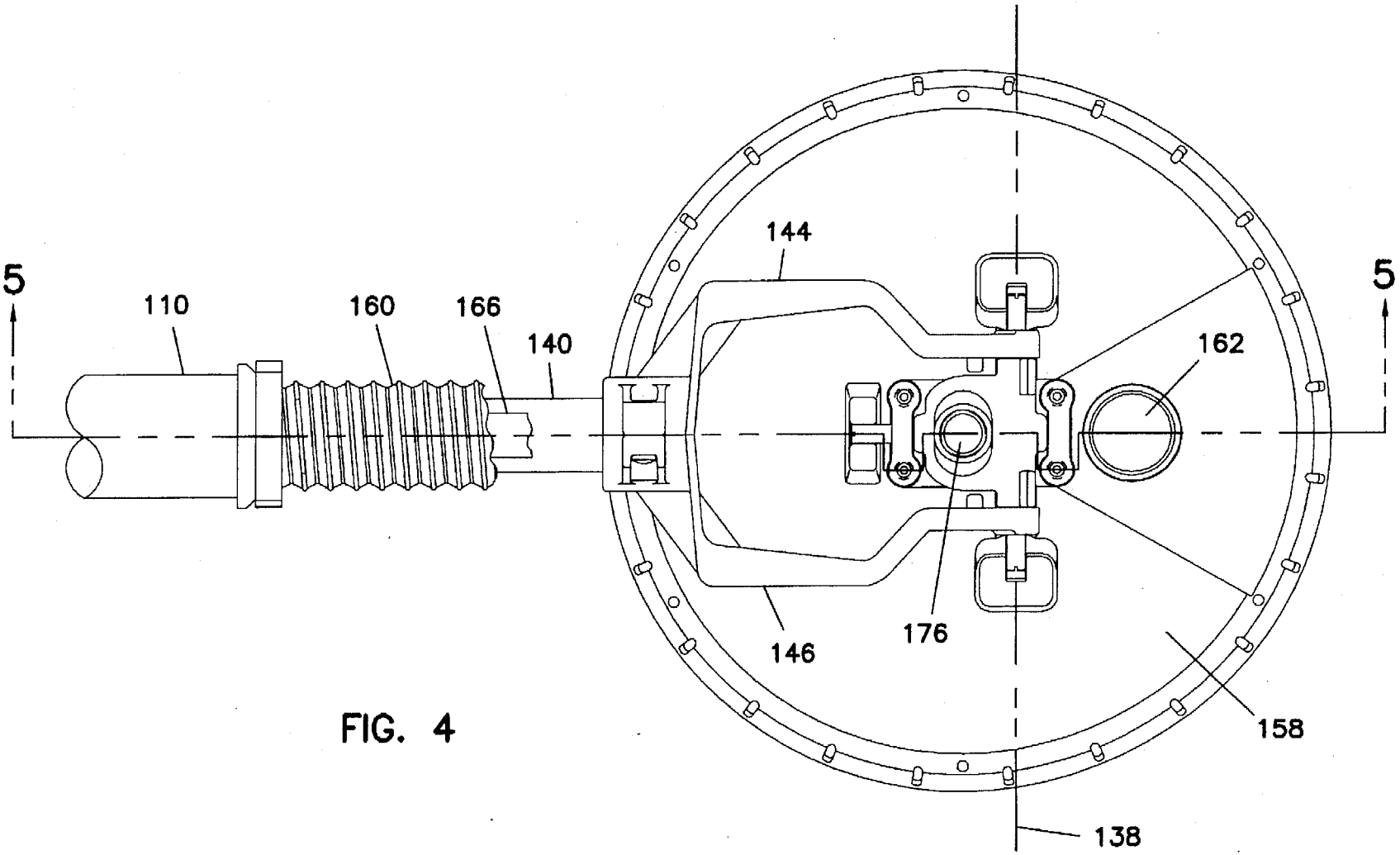
FIG. 4 is an exploded view of a sander head portion of the motorized sander shown in FIG. 1.
Figure 5:
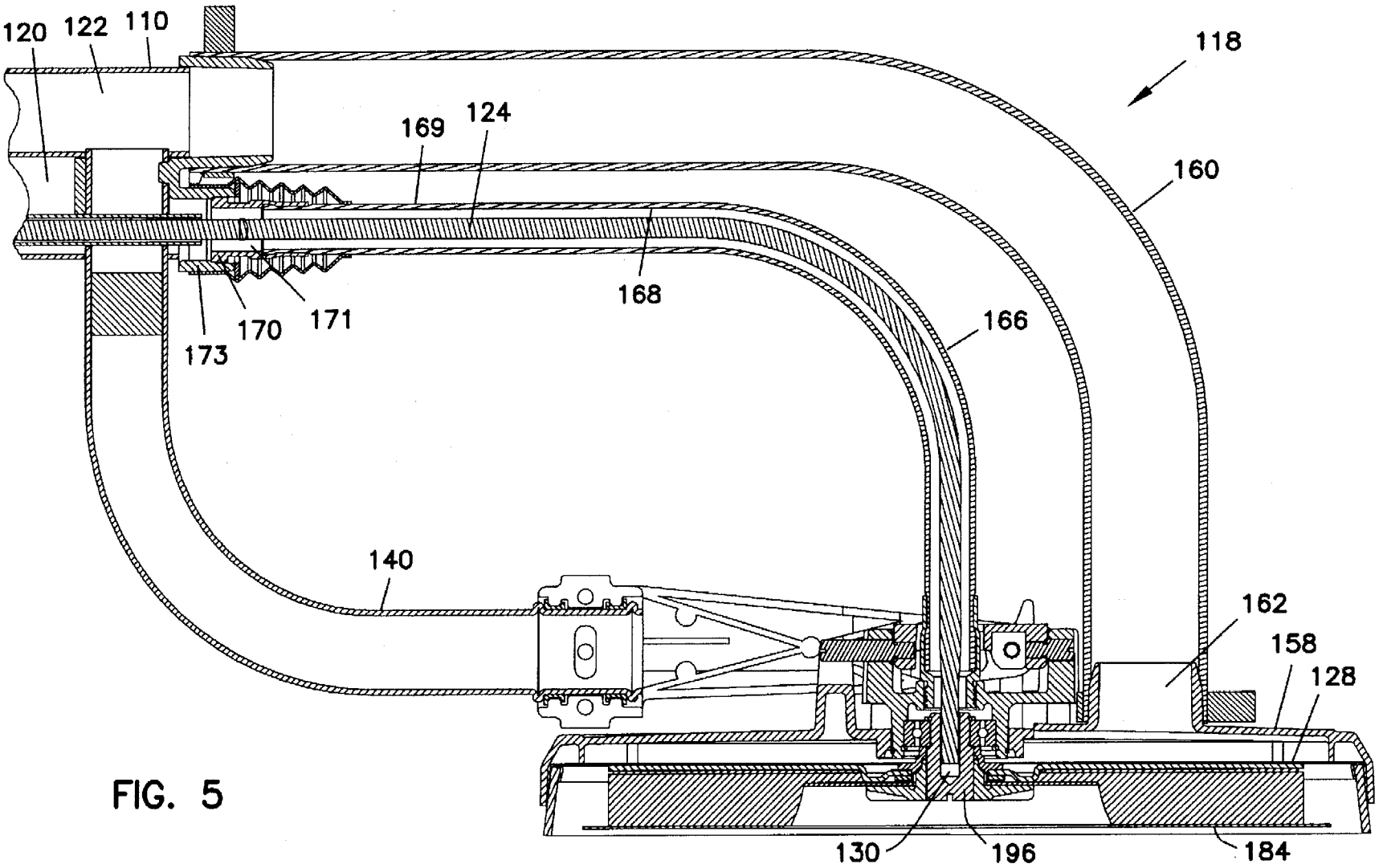
FIG. 5 is a side sectional view of the sander head portion shown in FIG. 4 at section line 5—5.

FIG. 4 is a top view of the sanding head 118 depicted in FIG. 2. Like reference numerals in FIG. 4 depict the same components as those shown in the other figures having the same reference numerals. FIG. 5 is a side sectional view of the sanding head 118 as shown in FIG. 2 on sectional line 5—5 of FIG. 4. A casing 166 is operatively coupled between the shroud 158 and the proximal end 110 of the tubular wand 108 through threaded spindle 196 such that the flexible drive shaft 124 extends therethrough. The casing defines an interior wall 168 spaced apart from the flexible drive shaft 124 to allow the flexible drive shaft 124 to bend about the first 136 and the second 138 axes such that kinking of the flexible drive shaft 124 is prevented. A ball joint 170 is operatively coupled between the casing 166 and the proximal end 110 such that the flexible driving shaft 124 passes therethrough the center of the ball joint 170. The ball joint 170 cooperates with the casing 166 to permit movement of the casing 166 about the second axis 138 while minimizing the changing length requirements for the flexible drive shaft that result from bending of the casing 166. This cooperation also minimizes any kinking that may result from the bending of the flexible drive shaft 124 as it passes through the ball joint 170. In the preferred embodiment the ball joint 170 includes a hole 171 which has a diameter larger than the diameter of the flexible drive shaft 124. In addition, the outer diameter of the ball joint 170 has a diameter which corresponds to the spherical diameter of the casting 173 and the diameter of the outer surface 169 of the casing 166. These precise relationships of the ball joint 170, casing 166, and flexible drive shaft 124 dimensions let the flexible drive shaft 124 bend within the casing 166 without excessively extending or reducing the length of the flexible drive shaft 124 that would still be required to engage the driving slot 130 and sanding drive plate 128.

Figure 6:
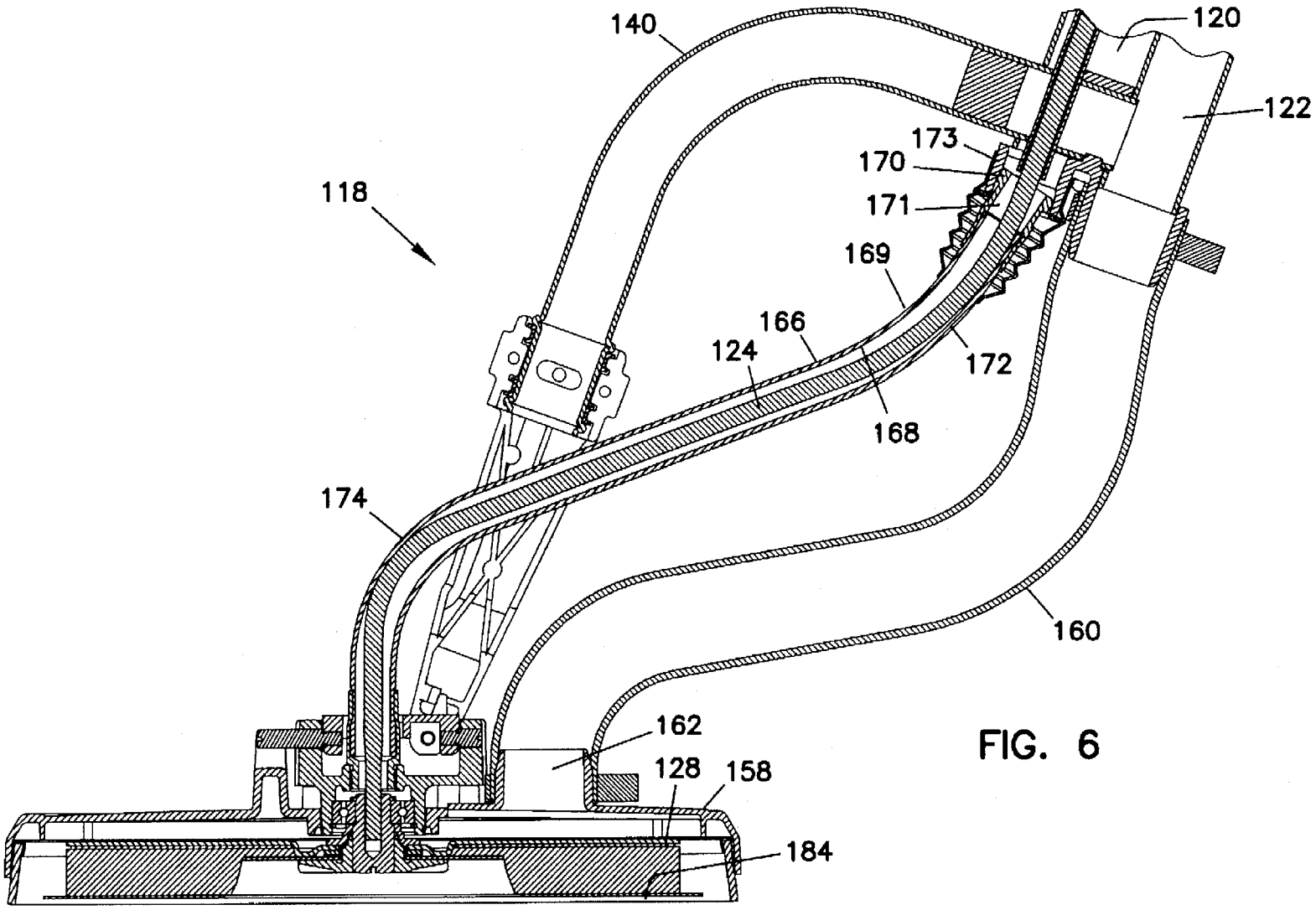
FIG. 6 is a side sectional view of the sanding head shown in FIG. 4 along section line 5—5 which is similar to FIG. 5 except that the sanding head is pivoted to a different position.

FIG. 6 is a sectional view of the sanding head 118 of FIG. 4 along section line 5—5 which is similar to FIG. 5 except that the sanding head 118 has been pivoted to a different position. In this situation ball joint 170 has allowed the flexible drive shaft 124 to be axially displaced from the central axes within the ball joint 170. In addition, the casing 166 also allows the flexible drive shaft 124 to axially displace from a center axis such that the flexible drive shaft 124 comes into contact with interior wall 168 at points 172 and 174. By allowing flexible drive shaft 124 to flex or displace no more than casing 166 does, potential kinking of the flexible drive shaft 124 resulting from flexing or bending of the casing 166 is minimized.

Returning to FIG. 4, the flexible drive shaft 124 preferably is mounted to a center point 176 of the sanding head 118. The pivot joint preferably is mounted to the sanding head 118 such that the second axis 138 is located on the opposite side of the center point 176 from the proximal end 110 of the tubular wand 108.

Referring once again to FIG. 2, the shroud 158 preferably is mounted within the sanding head 118 by a support housing 178 coupled to springs 180 which hold the lip 182 of the shroud 118 in a plane which extends beyond a plane formed by the sanding pad 184 and away from the pivot joint when the sanding head components are assembled together. The lip 182 and sanding pad 184 stay in these positions in a rest state until an external force is applied to the lip 182 towards the pivot joint such that the sanding pad 184 is exposed when the external force is applied and the springs 180 are compressed. In the preferred embodiment, the lip 182 of the shroud 158 further includes brush bristles 186.

In the preferred embodiment the sanding drive plate 128/sanding pad 184 is a rotary sanding pad having a generally circular shape. However, this sanding drive plate and sanding pad may be configured in other shapes. For example, a rectangular shaped or square pad could be used in a similar motorized sander which oscillates back and forth in an orbital pattern as a result of being driven by a flexible drive shaft. In the preferred embodiment, the sanding head 118 also includes an abrasive disc which is adhered to the sanding pad 184 and mounted concentrically on the sanding drive plate 128 such that the abrasive disc 184 can be driven rotatably by the flexible drive shaft 124. This abrasive disc 184 can be driven rotatably by the flexible drive shaft 124 through engagement of contacting surfaces 188 and 190 of the sanding drive plate 128 and the abrasive disc 184, respectively. Although the tool or tool system referred to in the above description is denoted as a "motorized" sander which uses an abrasive disc, this abrasive disc may consist of sandpaper, other abrasive papers, abrasive materials, abrasive systems, buffing materials, or the like.

Returning once again to FIG. 1 and FIG. 2, the flexible drive shaft 124 preferably is operably coupled in-line to the drive motor 112 such that bending of the flexible drive shaft within tubular wand 108 proximate the drive motor 112 is minimized.

Figure 7:
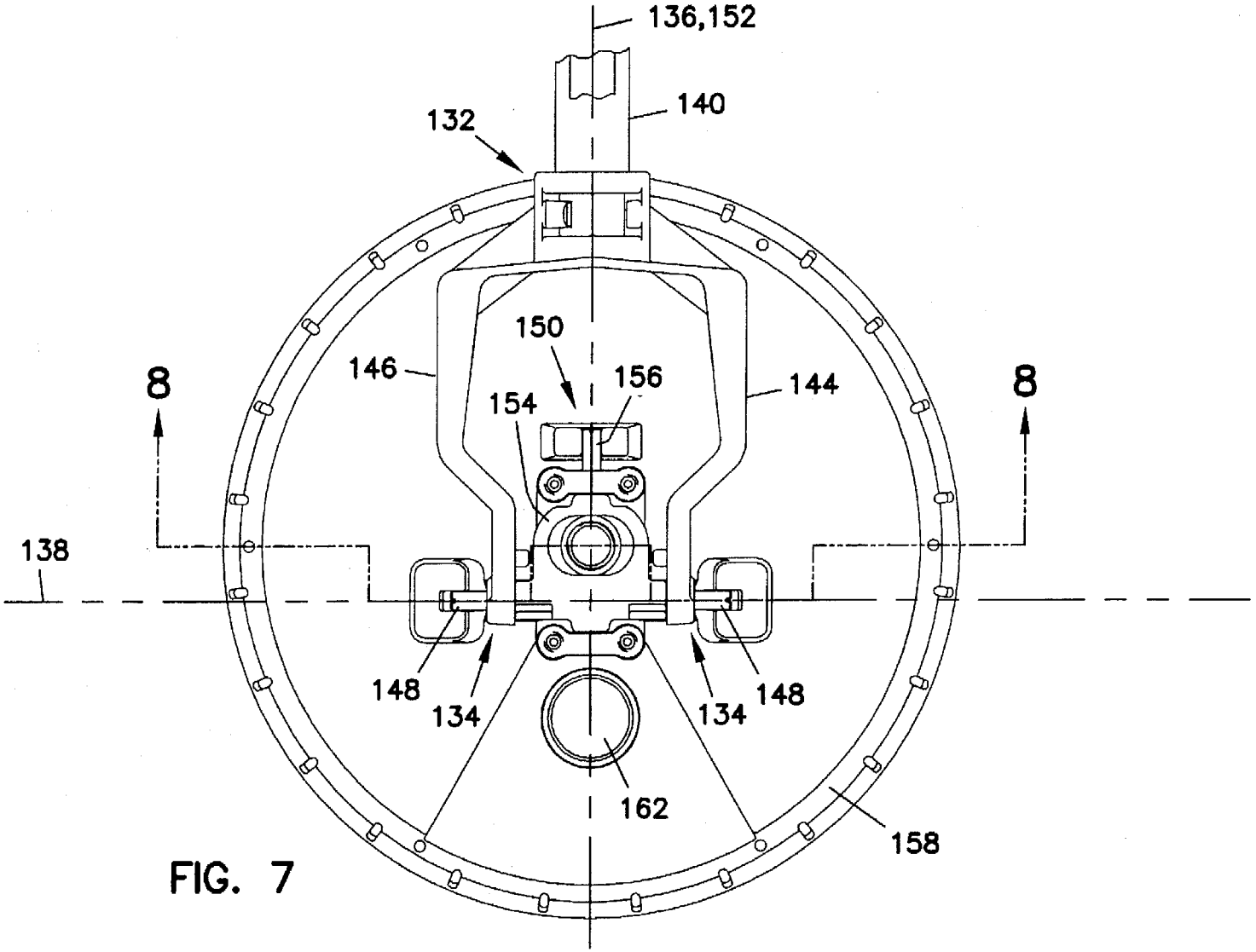
FIG. 7 is a top view of the sanding head shown in FIG. 1.
Figure 8:
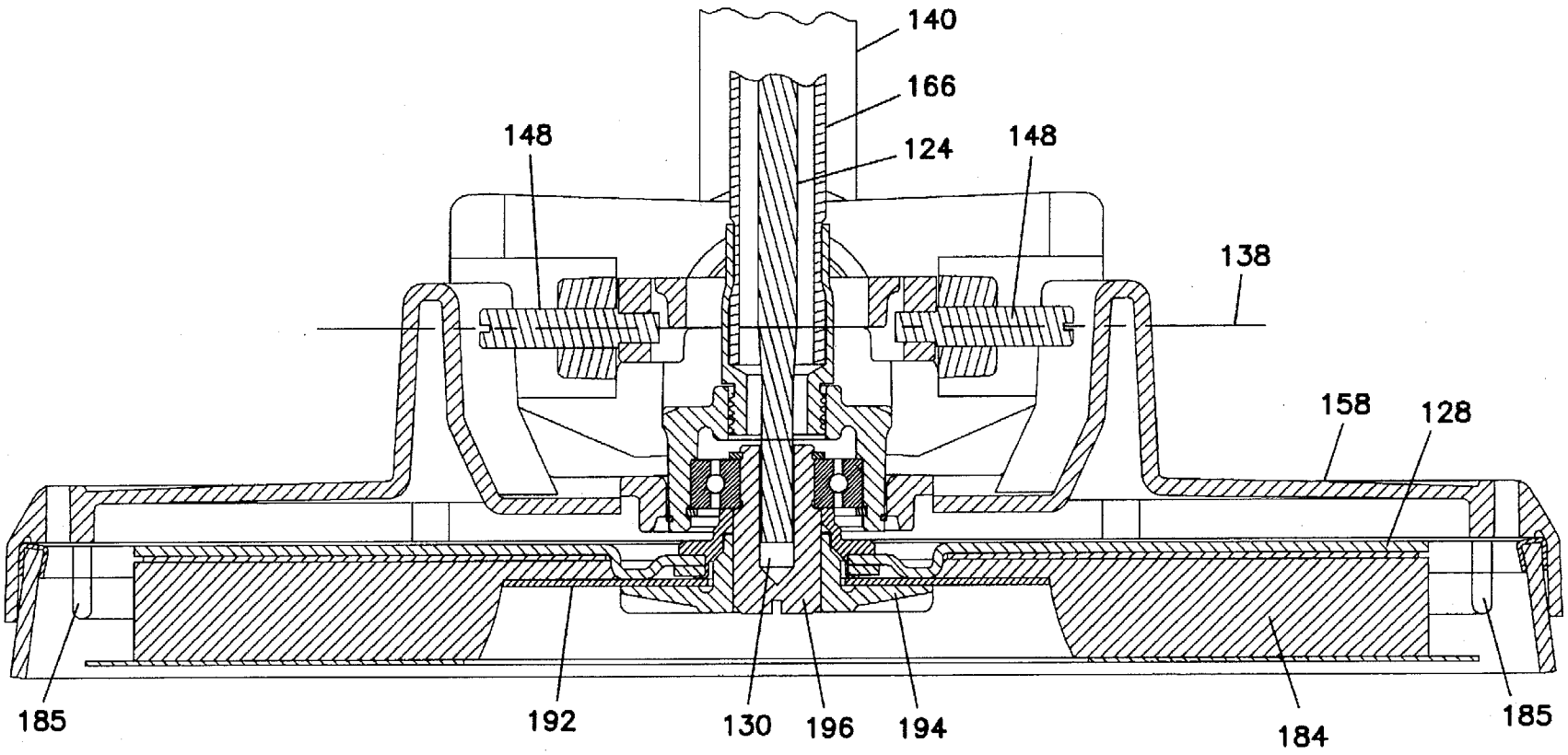
FIG. 8 is a sectional view of the sanding head shown in FIG. 7 at section line 8—8.
Figure 9:
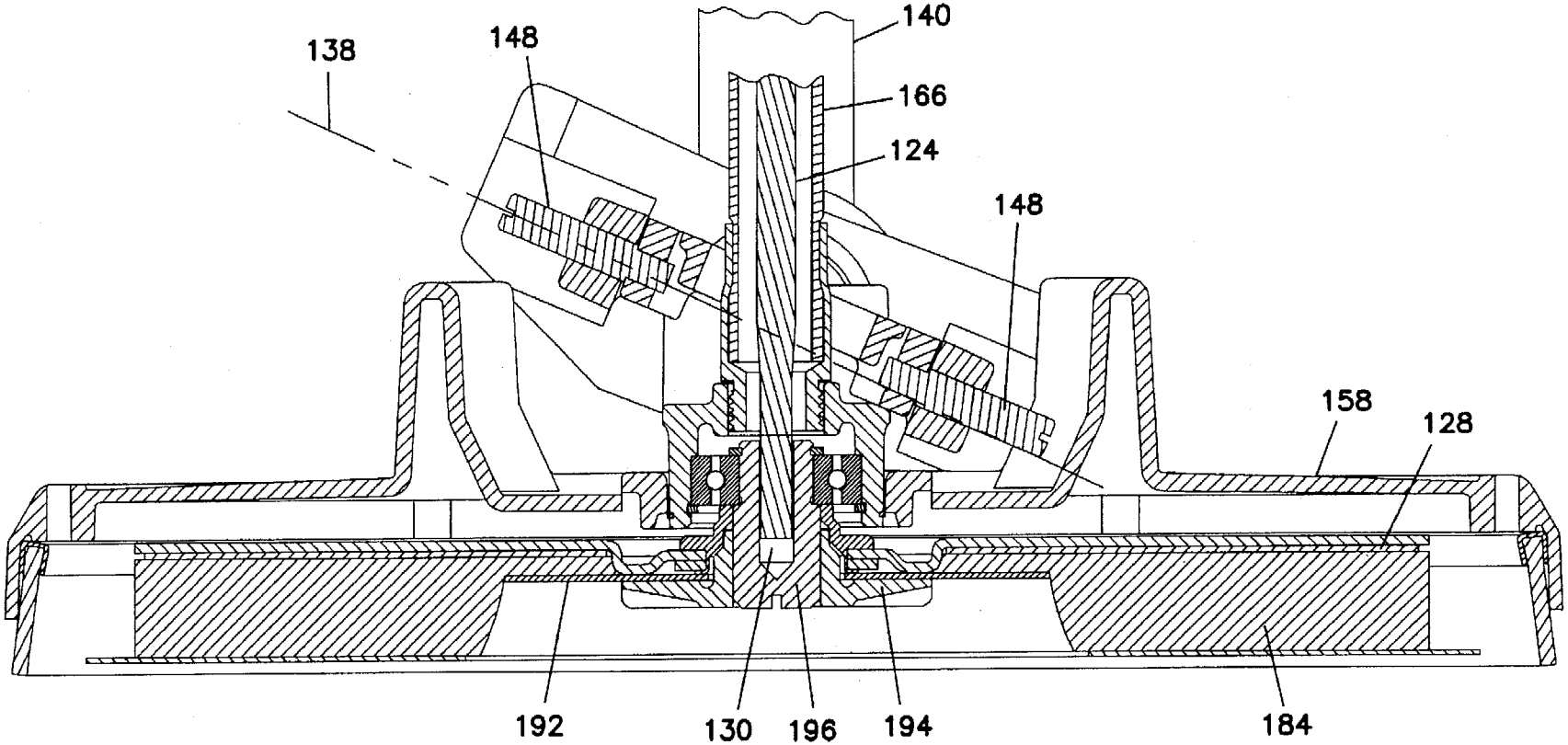
FIG. 9 also is a sectional view of the sanding head shown in FIG. 7 at section line 8—8 where the sanding head is pivoted about an axis.
Figure 10:
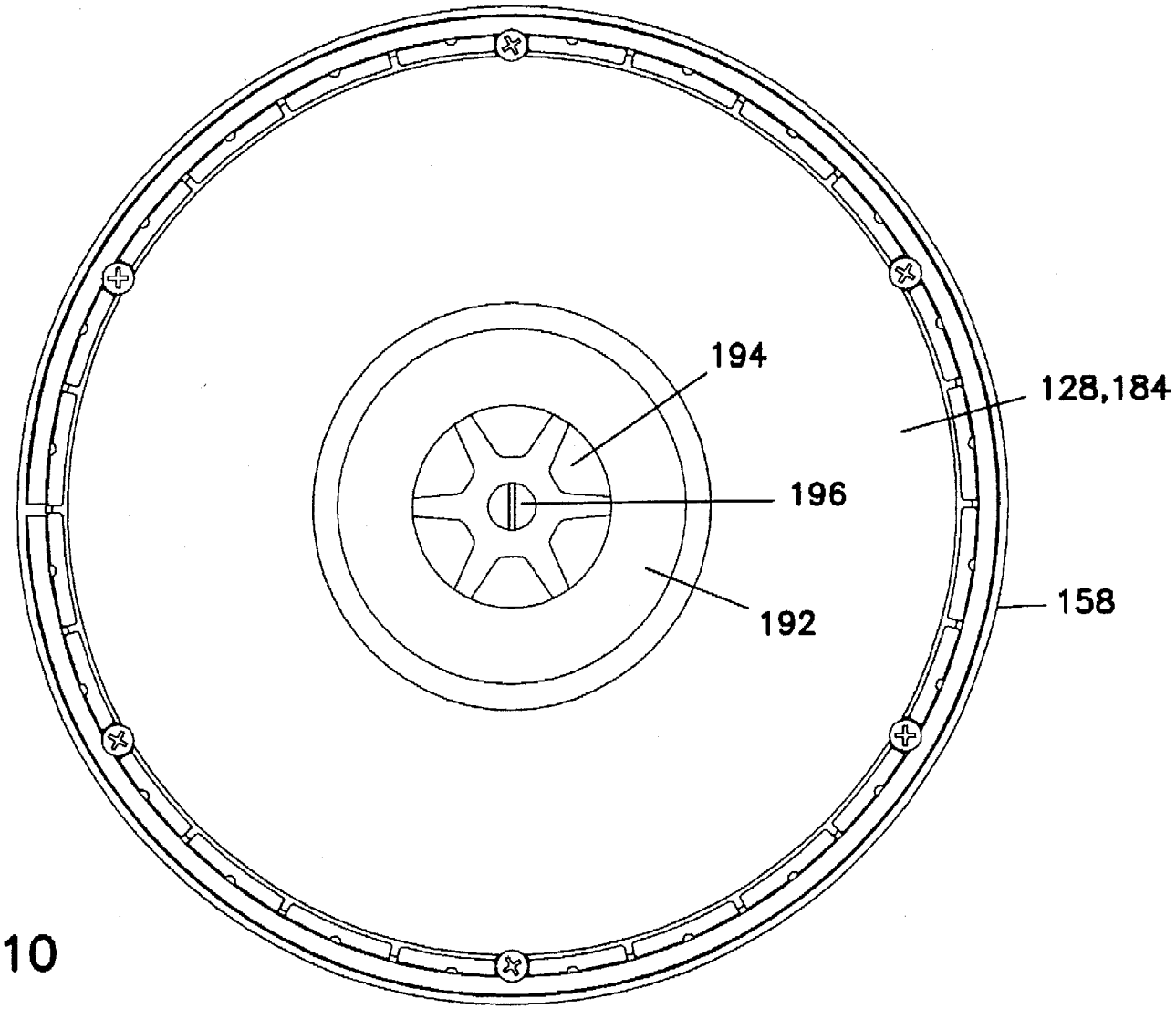
FIG. 10 is a bottom view of sanding head shown in FIG. 1.

FIG. 7 shows a top view of the sanding head 118 shown in FIG. 1. Also, FIG. 8 is a sectional view of the sanding head 118 of FIG. 7 on section line 8—8. Similarly, FIG. 9 is also a sectional view of the sanding head 118 of FIG. 7 on section line 8—8 where the sanding head is axially displaced or pivoted about axis 152. Also FIG. 10 is a bottom view of sanding head 118 of FIG. 1 where the sanding drive plate 128 and abrasive disc 184 are mounted in the shroud 158 by washer 192 and nut 194 over the threaded spindle 196. In FIGS. 7, 8, 9 and 10, the like reference numerals shown therein correspond to the like sander components shown in the other figures.

The following discussion, which is taken from an instruction manual on the operation of a drywall sander sold by the assignee of this patent application, details how the sander 100 can be used.

The sander 100, as shown in FIG. 1, is designed for sanding walls and ceilings that are made of drywall or plaster. The sander 100 provides a superior finish, and is faster than conventional finishing methods for both new construction and renovation work. Clean-up time is minimized by the use of an external vacuum cleaner (not shown) attached through hose clamp nut 102 to the sander 100.

The sander 100 is typically shipped with a 100 grit, abrasive disc installed. This abrasive is suitable for most applications. Abrasive discs of 120 grit, 150 grit, and 220 grit are available, for situations requiring a smoother finish and 80 grit discs are available for more aggressive sanding.

The sander 100 should be held by an operator with both hands on the main tube (i.e., tubular wand 108) with one hand on either side of the drive motor 112. It will be appreciated that the hands may be positioned anywhere along the main tube 108 to provide the best combination of reach and leverage for the particular application. The operator's hands should be kept on the main tube 108. In particular, the hands should not be placed into area around the sanding head 118, because the sanding head 118 swivels/pivots in multiple directions and could pinch a hand.

To connect the sander 100 to the vacuum cleaner a vacuum hose approximately 13 feet long should be provided. The vacuum hose preferably has a standard 1¼" vacuum cleaner connector on one end and a special swivel connector on the other end which connects to the sander 100. In addition, one 1¼" to 2½" adapter (i.e., which adapts the 1¼" hose connector to fit a 2½" vacuum cleaner collection port) may be provided for use when necessary. Also, six straps to connect the sander 100 electric power cord to the vacuum hose can be provided to prevent tangling of the cord by strapping the cord to the vacuum hose. A special vacuum cleaner dust bag, rated for use with drywall dust (suitable for use in most shop type vacuum cleaners) should also be provided.

The special drywall dust bag may be installed into the vacuum cleaner by following the instructions supplied with the vacuum cleaner. If this dust bag does not fit the vacuum cleaner correctly, a suitable filter bag that is rated for drywall dust should be purchased and installed. Failure to use a dust bag rated for drywall dust will increase the level of airborne dust particles in the work area. Continued and prolonged exposure to high concentrations of airborne dust may affect the respiratory system function.

The vacuum hose should be connected to the sander 100. This is accomplished in the preferred embodiment by opening the sander's hose connector 104 by turning the large nut 102 counter-clockwise a couple of turns. Push the vacuum hose swivel connector into the sander 100 connector 104 and seat firmly. Turn the large nut 102 clockwise to tighten connector 104.

In the preferred embodiment, the six "hook & loop" type straps are installed to prevent tangling of the sander 100 cord and the vacuum hose. This can be accomplished by laying the cord and the vacuum hose out parallel to each other. The straps should be spaced at approximately two foot intervals, beginning two feet from the sander 100. The long end of each strap should be wrapped around the vacuum hose. Subsequently, the short end of each strap should be wrapped around the cord.

The vacuum hose should be connected to a vacuum cleaner to be used, using the 1¼" to 2½ adapter, if necessary.

The sander 100 as shown in FIG. 1 preferably is equipped with a "rocker" type switch 114. The top end of the switch button 114 is labeled OFF, and the bottom end of the button is labeled ON. To start the sander 100, depress the bottom (ON) end of the switch button 100. To stop the sander 100, depress the top (OFF) end of the switch button 114.

The sander preferably is equipped with a variable speed control 116. The speed is adjusted by turning the control knob 116. In the preferred embodiment, the control knob is numbered "1" through "5" with "1" being the slowest speed (approximately 1000 rotations per minute (RPM)) and "5" being the fastest speed (approximately 1650 RPM). Use the higher speed settings for fast stock removal. Use the lower speed setting to reduce removal rate for more precise control.

As shown in FIG. 2, a brush-type skirt 186 surrounds the abrasive pad 184. This skirt 186 serves two purposes. First, the skirt 186 extends below the surface of the abrasive pad 184 so that it contacts the work surface first. This positions the sanding head 118 parallel to the work surface before the abrasive pad 184 contacts the work, preventing the abrasive pad 184 from "gouging" the work. Second, the skirt 186 in conjunction with a second lip 185 (shown in FIG. 8 as extending around the circumference of the shroud 158) help to contain the drywall dust until the vacuum cleaner pulls it away. To replace the skirt 186, the abrasive pad 184 can be removed by using a Phillips screwdriver to remove the six retaining screws 198 Then, the skirt 186 can be lifted out of the shroud/housing 158. A new skirt 186 can be positioned in the housing 158, and the six retaining screws 198, are installed, finally the abrasive pad 184 can be replaced.

The sander 100 has a unique articulating sanding head 118. The head 118 can swivel in multiple directions (i.e., around axes 136, 138, and 152), allowing the abrasive pad 184 to conform to the work surface. This enables the operator to sand the top, middle and bottom of a wall or ceiling without changing his position.

To begin sanding, position the sander 100 lightly against a work surface (apply just enough pressure to align the sanding head 118 with the work surface). Apply additional pressure to engage the abrasive pad 184 to the work surface, while moving the sander 100 in an overlapping pattern to smooth the drywall compound down to a "featheredge".

To replace the abrasive pad 184, grasp the abrasive pad 184 and the sander housing 158 which has the pad 184 clamped thereto so that pad 184 rotation is prevented. Rotate the pad 184 retaining nut 194 counter-clockwise and remove. Lift off the large metal washer 192 and the abrasive pad 184. It should be noted that when the abrasive pad 184 is lifted off the sander shroud 158, the abrasive back-up disc 128 (i.e., driving plate) is exposed. This back-up disc 128 is also covered with an abrasive material. This abrasive material is only used to prevent "slippage" between the back-up disc 128 and the foam backed abrasive pad 184, it is not suitable for use as a sanding abrasive. Position a new abrasive pad 184 on to the back-up disc 128, making sure that the center hole in the abrasive disc 184 is centered on the hub 196. Position the large metal washer 192 and the retaining nut 194 into the sander shroud 158. Rotate the retaining nut 194 clockwise to hand tighten while holding the abrasive pad 184 fixed as described above.

It is to be understood that even though numerous characteristics and advantages of various embodiments of the present invention have been set forth in the foregoing description, together with details of the structure and function of various embodiments of the invention, this disclosure is illustrative only, and changes may be made in detail, especially in matters of shape, size and arrangement of parts within the principles of the present invention to the full extent indicated by the broad general meaning of the terms in which the appended claims are expressed.

What is claimed is:

1. A motorized rotary tool comprising:

(a) a drive motor mounted on a distal end of a tubular wand;

(b) a drive shaft operatively coupled to the drive motor and extending along the length of the tubular wand; and (c) a head mounted by a pivotal joint to a proximal end of the tubular wand, the head including a rotary pad operatively coupled to the flexible drive shaft such that the rotary pad can be driven rotably by the drive shaft, the pivotal joint comprising a first and a second flexible joint, the first joint being configured to pivot about a first axis which is different from a second axis about which the second joint pivots.

2. The motorized rotary tool of claim 1 wherein the first axis is perpendicular to the second axis.

3. The motorized rotary tool of claim 1 wherein the first joint comprises a U-joint having a rigid tube fit into a rotable collet on a U-shaped retaining member, the rotable collet and U-shaped retaining member being configured to freely pivot about the first axis.

4. The motorized rotary tool of claim 3 wherein the second joint comprises a first pin mounted between open arms of the U-shaped retaining member, the head being coupled to the first pin such that the head pivots about the second axis which extends along the length of the first pin.

5. The motorized rotary tool of claim 4 wherein the pivotal joint further comprises a third joint configured to pivot about a third axis which is different from the first and the second axis.

6. The motorized rotary tool of claim 5 wherein the third joint comprises a rigid plate located between the open arms of the U-shaped retaining member and a second pin mounted perpendicular to the first pin, both pins passing through holes in the rigid plate, the third axis extending along the length of the second pin.

7. The motorized rotary tool of claim 1 wherein the head further includes a shroud surrounding a peripheral edge of the rotary pad.

8. The motorized rotary tool of claim 7 further comprising a vacuum line operatively coupled between a vacuum hole defined by the shroud and the proximal end of the tubular wand and further extending along the length of the tubular wand to a vacuum outlet at the distal end of the tubular wand, the vacuum outlet being formed to receive a flexible vacuum hose.

9. The motorized rotary tool of claim 8 wherein the shroud comprises a recessed region defined by a surface of the shroud surrounding the vacuum hole proximate the rotary pad, the recessed region being formed such that the rotary pad is prevented from sealing the vacuum hole when force is applied to a planar surface of the rotary pad toward the shroud.

10. The motorized rotary tool of claim 8 wherein the tubular wand includes a first and a second chamber within the wand, the drive shaft extending along the length of the tubular wand through the first chamber, and the vacuum line extending along the length of the tubular wand through the second chamber.

11. The motorized rotary tool of claim 7 wherein the shroud is mounted within the head by springs which hold a lip of the shroud in a plane which extends beyond a plane formed by the rotary pad and away from the pivotal joint until an external force is applied to the lip towards the pivotal joint such that the rotary pad is exposed when the external force is applied.

12. The motorized rotary tool of claim 11 wherein the lip of the shroud comprises brush bristles.

13. The motorized rotary tool of claim 1 wherein the head further comprises an abrasive disc mounted concentrically on the rotary pad such that the abrasive disc can be driven rotably by the drive shaft.

14. The motorized rotary tool of claim 13 wherein the abrasive disc can be driven rotably by the drive shaft through engagement of contacting surfaces of the rotary pad and the abrasive disc.

15. The motorized rotary tool of claim 1 wherein the drive shaft is operatively coupled in-line to the drive motor such that bending of the drive shaft proximate the drive motor is minimized.

16. The motorized rotary tool of claim 1 wherein:

(a) the drive motor is a variable speed fractional horsepower electric motor; and (b) motor speed is set by a variable speed switch coupled to the motor.

* * * * *